United States Patent [19]

Kanda et al.

[11] Patent Number: 4,999,592

[45] Date of Patent: Mar. 12, 1991

[54] CONVERTER FOR PLANAR ANTENNA

[75] Inventors: Minoru Kanda; Mikio Komatsu; Yasuhiro Fujii; Toshio Abiko; Kyoji Masamoto; Yasumasa Ogawa; Tuyoshi Hashimoto, all of Osaka, Japan

[73] Assignee: Matsushita Electric Works, Ltd., Osaka, Japan

[21] Appl. No.: 434,448

[22] Filed: Nov. 13, 1989

[30] Foreign Application Priority Data

| | | | |
|---|---|---|---|
| Nov. 12, 1988 | [JP] | Japan | 63-286085 |
| May 25, 1989 | [JP] | Japan | 1-131956 |
| May 26, 1989 | [JP] | Japan | 1-134014 |
| Jul. 26, 1989 | [JP] | Japan | 1-87641[U] |

[51] Int. Cl.[5] ..... H01P 5/107

[52] U.S. Cl. ..... 333/26; 333/33

[58] Field of Search ..... 333/21 R, 26, 33

[56] References Cited

U.S. PATENT DOCUMENTS

| | | | |
|---|---|---|---|
| 3,638,148 | 1/1972 | Hallford et al. | 333/33 X |
| 3,681,714 | 8/1972 | Terakawa | 333/21 R |
| 4,453,142 | 6/1984 | Murphy | 333/26 |
| 4,550,296 | 10/1985 | Ehrlinger et al. | 333/26 |
| 4,716,386 | 12/1987 | Lait | 333/26 |
| 4,742,571 | 5/1988 | Letron | 333/26 X |

FOREIGN PATENT DOCUMENTS

| | | | |
|---|---|---|---|
| 0253128 | 1/1988 | European Pat. Off. . | |
| 253128 | 1/1988 | European Pat. Off. . | |
| 49003 | 3/1984 | Japan | 333/26 |
| 117804 | 7/1984 | Japan | 333/26 |
| 63-30004 | 2/1988 | Japan . | |
| 30004 | 2/1988 | Japan . | |

*Primary Examiner*—Paul Gensler

*Attorney, Agent, or Firm*—Burns, Doane, Swecker & Mathis

[57] ABSTRACT

A converter for use with planar antennas has a probe projected into an input part of waveguide structure as extended along a plane including a circuit board in a body of the converter, an opening of which input part being disposed in parallel to the plane, whereby the converter input part is allowed to have a thickness limited within the thickness of the converter body to remarkably reduce the entire thickness for effectively realizing a minimization in the thickness of the converter.

4 Claims, 4 Drawing Sheets

CONVERTER FOR PLANAR ANTENNA

TECHNICAL BACKGROUND OF THE INVENTION

This invention relates to a frequency converter for use with planar antennas.

The converter of the type referred to can comprise a low noise block down (LNB) converter which can be effectively utilized in the field of satellite broadcasting reception as well as satellite communication.

DISCLOSURE OF PRIOR ART

The Planar antennas which are easier to be installed and inexpensive have been increasingly widely utilized in place of parabolic antennas, and various types of the converter for the planar antennas have been concurrently suggested.

In European Patent Application No. 0 253 128 Al, for example, K. Fukuzawa et al have suggested a converter for planar antennas, in which a flange is provided to extend out of a corner of converter body so as to define an input part forming a waveguide structure, and a probe is projected from the converter body into this input part. While K. Fukuzawa et al disclose an attempt to reduce the thickness of planar antenna, there has been disclosed no idea that can fully satisfy a demand of minimizing the thickness of the converter itself. That is, subject invention of K. Fukuzawa et al is of a structure in which the flange defining the input part is provided on a rear surface at one corner of the converter body, so that there has been such a problem in realizing the thickness minimization wherein the entire thickness of the converter corresponds to the sum total of the thickness of the converter body and the thickness of the flange.

In German Patent Application P 36 23 904.6, further, A. Irsanker et al have suggested a converter for the planar antennas which has a flange forming a waveguide structure is secured to a corner of converter body. However, this converter of Irsanker et al also fails to suggest any effective idea of sufficiently reducing the thickness of the converter.

TECHNICAL FIELD

An object of the present invention is, therefore, to provide a converter for planar antennas which is capable of achieving the thickness minimization to a sufficiently satisfiable extent, and a concurrent reduction of required space for mounting the converter.

According to the present invention, this object can be attained by a converter for the planar antenna, wherein the converter is provided for being disposed on one surface of the planar antenna, a flange defining an input part forming a waveguide structure is provided to an end wall of a body of the converter, and a probe extended out of the body for carrying out a microstrip-to-waveguide transform is projected into the input part, characterized in that the probe is extended in a direction in which a plane including a circuit board of the converter body extends, and the input part has an opening disposed in parallel to the plane.

Other objects and advantages of the present invention shall be made clear in following description of the invention detailed with reference to its preferable embodiments shown in accompanying drawings.

Figure 1:
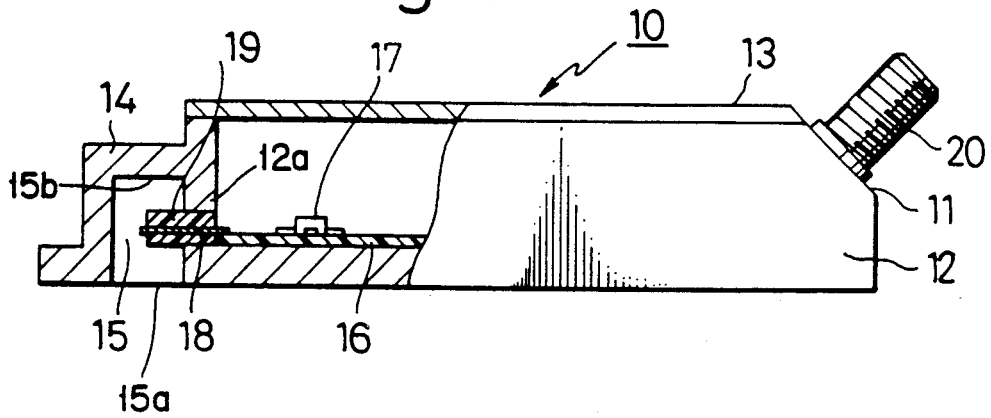
FIG. 1 shows in a side view with a part in section an embodiment of the converter for the planar antenna according to the present invention.

While the present invention shall now be explained to details with reference to the respective embodiments shown in the drawings, it should be appreciated that the intention is not to limit the present invention only to these embodiments shown, but rather to include all modifications, alterations and equivalent arrangements possible within the scope of appended claims.

DISCLOSURE OF PREFERRED EMBODIMENTS

Figure 2:
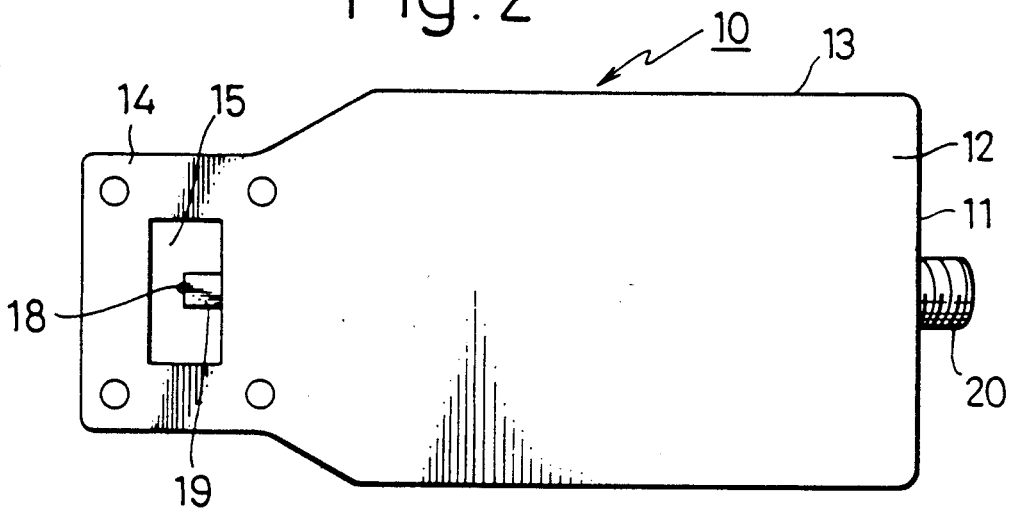
FIG. 2 is a bottom plan view of the converter shown in FIG. 1.

Referring to FIGS. 1 and 2, a converter 10 for the planar antennas includes a casing 11 which is formed by a metal to comprise a body 12 generally of a shallow box shape opened on one side and a cover 13 for closing the opened side of the body 12. At one end part in a longitudinal direction in the present instance, the body 12 has an integral flange 14 of a smaller box shape opened on a side opposite to the open side of the body 12, so as to define an input part 15 forming a waveguide structure. The opening 15*a* of the input part lies in a plane parallel to a plane of a circuit board 16.

On an inner bottom surface of the body 12 of the casing 11, a circuit board 16 formed by means of such dielectric member as Teflon, fiber glass or the like is disposed, with a circuit pattern formed on the circuit board 16, and such electronic circuit parts 17 as HEMT (i.e., a high electron mobility transistor) and the like are mounted onto the circuit pattern. A probe 18 extended in a direction in which a plane including the circuit board 16 extends is connected at an end onto an input side of the circuit pattern by means of, for example, a soldering and is projected through a wall 12*a* at one end of the body 12, into the input part 15 for realizing a microstrip-to-waveguide transform. In this position, the probe 18 is enclosed coaxially in a Teflon rod 19, so that the probe 18 can be positioned highly precisely in the one end wall of the body 12 through the rod 19. Since the microstrip-to-waveguide transform characteristics are influenced by the position of the probe 18, such precise positioning of the probe 18 by means of the Teflon rod 19 with respect to the one end wall of the casing body 12 allows a fixing at the optimum position of the probe 18, whereby any loss in the microstrip-to-waveguide transform can be effectively reduced to render the transform to be stable. It is preferable in this case to dispose the probe 18 in the input part 15 so as to be at a distance of $\lambda g/4$ from innermost wall surface 15*b* of the input part 15, in order to improve the microstrip-to-waveguide transform efficiency.

At the other end wall of the casing 11, there is secured an output connector 20, so as to project from the casing 11 preferably in diagonal relationship thereto on the open side of the body 12, allowing a lead wire connected to an output side of the circuit pattern on the circuit board 16 to be accessible through the connector 20.

Figure 3:
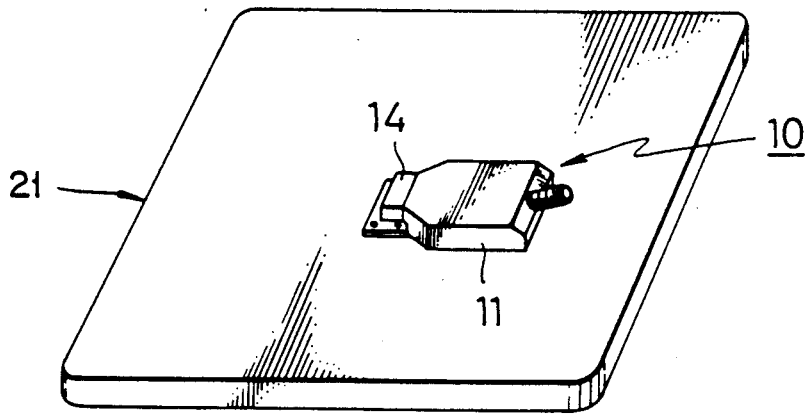
FIG. 3 shows in a perspective view a state in which the converter of FIG. 1 is mounted onto a planar antenna.

In the converter 10 for the planar antennas in the embodiment of FIGS. 1 and 2, the casing 11 and its flange 14 forming the input part 15 of waveguide structure are so arranged that the probe 18 is extended from the circuit board 16, along the plane including the circuit board 16. That is, the casing 11 and flange 14 are disposed on a single and common plane, so that the presence of the flange 14 which defines the input part 15 as a waveguide means does not serve to increase the overall thickness of the converter 10. Consequently, the converter 10 can be made compact to sufficiently minimize the thickness for remarkably saving the required mounting space for the converter so that, when the converter 10 is mounted to a planar antenna 21 as shown in FIG. 3, the spatial condition for mounting the planar antenna with the converter can be effectively mitigated.

Figure 4:
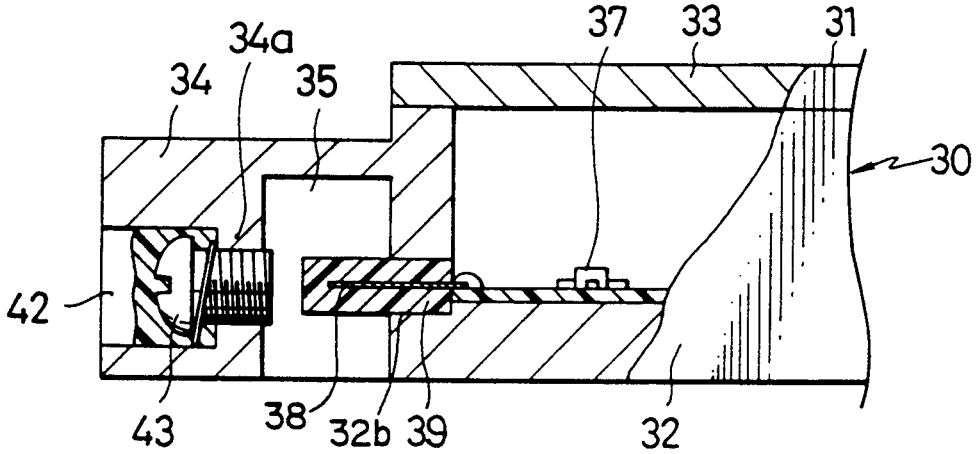
FIG. 4 is a fragmentary sectioned view showing another embodiment of the converter according to the present invention.

Referring next to FIG. 4, there is shown another embodiment of the converter according to the present invention, in which a casing 31 of the converter 30 is provided at an end wall 34*a* of a flange 34 opposing one end wall 32*a* of a casing body 32 with a recess 42. An adjusting screw 43 made of a metal is inserted into the recess 42 and driven through the end wall 34*a* to project into an input part 35 defined in the flange 34 so as to oppose an extended end of a probe 38 which projects into the input part 35 through an aperture 32*b* in the wall 32*a*. The probe is held by a Teflon rod 39, and the screw is substantially in alignment with the extended direction of the probe 38. The extent of the driving of the screw 43 into the input part 35, that is, the opposing distance between the probe 38 and the adjusting screw 43 is this made variable so that the input impedance upon the microstrip-to-waveguide transform can be matched. While such disposition of the adjusting screw 43 for being driven toward and away from the probe 38 is operationally preferable and the probe 38 and screw 43 are substantially coaxially aligned, a plurality of the adjusting screws may alternatively be provided at proper positions in the input part 35 where the screws can give influence on the microstrip-to-waveguide transform characteristics. It may be also possible to directly pass the adjusting screw 43 through the end wall 34*a* of the flange, without thickening the end wall 34*a* nor forming therein the recess 42. When the recess 42 is provided, on the other hand, a proper sealing material may be filled in the recess 42 after adjustment of the screw 43. Further, it is preferable to form the Teflon rod 39 to be longer than the probe 38 so that the probe 38 may be prevented from being directly touched by the adjusting screw 43 upon its driving through the end wall. It should be appreciated here that the longer Teflon rod 39 covers the extended end of the probe 38 so that, even when the adjusting screw 43 is excessively driven into the input part 35, the screw 43 is not allowed to contact with the probe 38 so as not to have the same eventually grounded through the flange 34 and body 32.

In the present embodiment of FIG. 4, the same components as those in the foregoing embodiment of FIGS. 1 and 2 are denoted by the same reference numerals as those used in FIGS. 1 and 2 but as added by 20, and other arrangement and operation than those referred to in the above are the same as in the embodiment of FIGS. 1 and 2, achieving also the sufficient thickness minimization.

Figure 5:
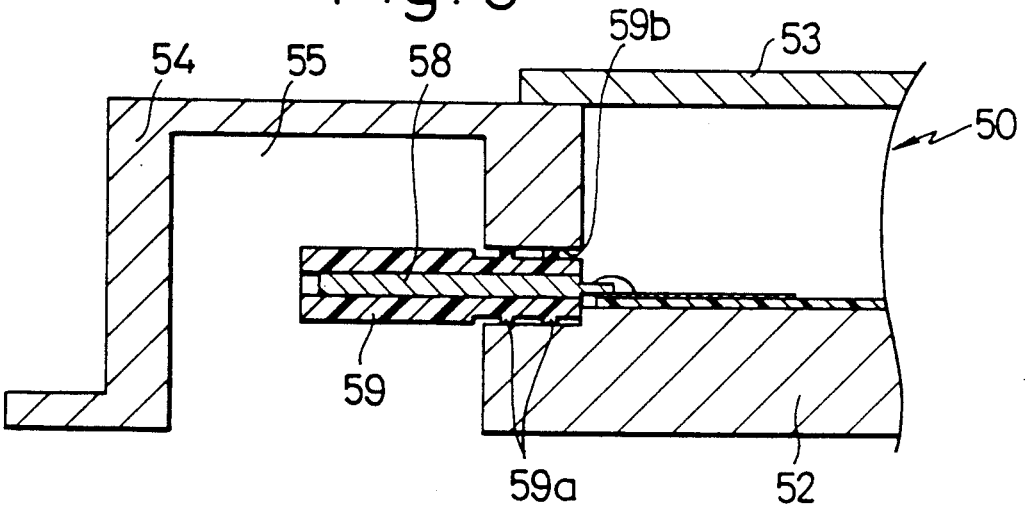
FIG. 5 shows in a fragmentary sectioned view still another embodiment of the converter according to the present invention.
Figure 6:
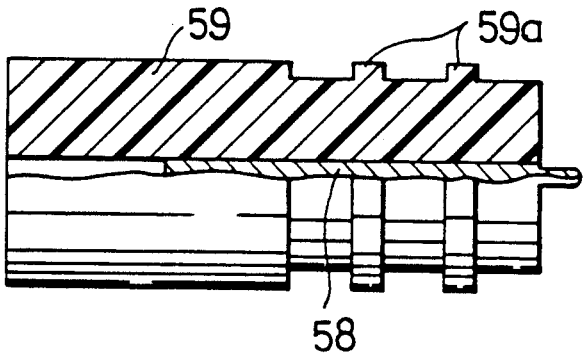
FIG. 6 is a side view as magnified with a part sectioned of a probe employed in the converter of FIG. 5.

According to one of remarkable features of the present invention, there is attained an increased retentive force of the Teflon rod enclosing the probe at the one end wall of the casing. Referring to FIGS. 5 and 6, a Teflon rod 59 enclosing and retaining the probe 58 in the converter 50 of this embodiment is reduced in its diameter at one end portion while leaving a plurality of annular projections 59*a* or, in other words, such annular projections 59*a* are provided by forming a plurality of annular grooves on the one end portion of the rod. In that regard, a Teflon rod as in the embodiment of FIGS. 1 and 2 having no projection nor groove and having a relatively larger diameter than a penetrating hole through the one end wall of the casing causes the rod urged into the hole to be subjected to a force acting to the rod so as to escape out of the hole, so as not to be able to stably retain the probe in position. On the other hand in an event where the diameter of the rod is relatively smaller than the hole a bumpy motion of the rod is caused to occur with respect to the casing body so as not to be able to achieve the highly precise position of the probe any more, causing a risk of deterioration to arise in sealing function by the rod. According to the present embodiment, here, the one end portion of the Teflon rod 59 enclosing the probe 58 as urged into a penetrating hole 59*b* in the one end wall of the casing body 52 is forced to contact peripheral wall of the hole 59*b* only at the annular projections 59*a* so that, even when the diameter of the rod 59 or of the annular projections 59*a* is larger than that of the hole 59*b*, the force acting on the rod 59 to cause it to escape out of the hole can be remarkably reduced. The Teflon rod 59 is thereby held stably and tightly in the hole 59*b*, to allow the probe 58 held by the rod 59 to be highly precisely positioned.

Figure 7:
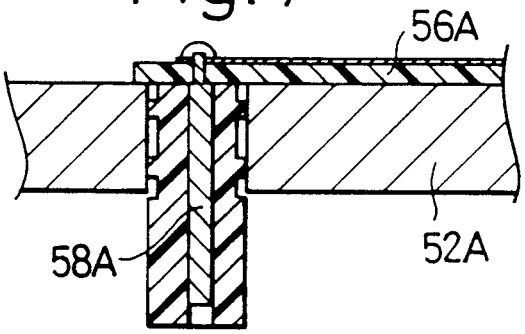
FIG. 7 shows in a fragmentary sectioned view a further embodiment of the converter according to the present invention, at a part where a probe is mounted.

This arrangement is also effective to achieve the same operation as in the above even when, as shown in FIG. 7 a probe 58A is mounted to the casing body 52A at right angles with respect to the circuit board 56A. Further, in the embodiment of FIGS. 5 and 6, the Teflon rod 59 may be provided at an end edge with an annular projection for engaging with peripheral edge of the penetrating hole 59*b* so as to improve the action of preventing the rod 59 from escaping out of the hole.

In the embodiment of FIGS. 5 and 6, the same components as those in the embodiment of FIGS. 1 and 2 are denoted by the same reference numerals as those used in FIGS. 1 and 2 but as added by 40, and other arrangement and operation than those which already referred to are the same as those in the case of FIGS. 1 and 2, in attaining the sufficient thickness minimization of the converter.

Figure 8:
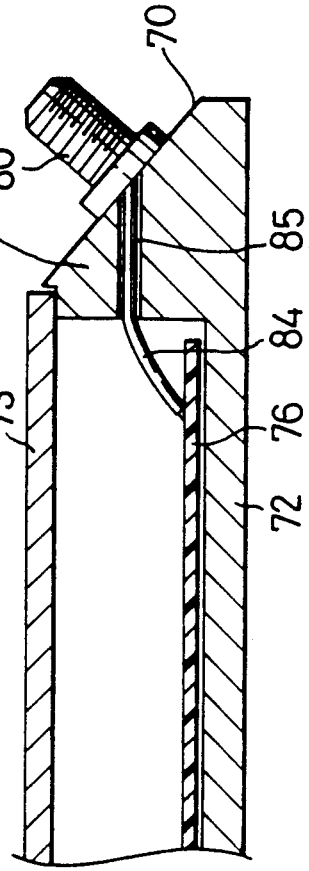
FIG. 8 is a fragmentary side view showing yet another embodiment of the converter according to the present invention, at a part where a connector is mounted.
Figure 10:
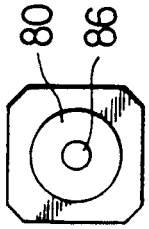
FIG. 10 is a plan view of the output connector in the converter of FIG. 8.
Figure 9:
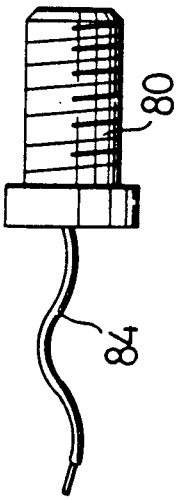
FIG. 9 shows in a side view the output connector employed in the converter of FIG. 8.

According to another remarkable feature of the present invention, there is provided an arrangement effective for remarkably improving any mismatching of impedance at the output connector part for rendering the return loss to be eliminated. Referring to FIGS. 8 to 10, a converter 70 in this embodiment is slanted at the other end wall of a body 72 of a casing 71 than the end wall having the flange defining the input part as in the foregoing embodiments. An output connector 80 is secured to this slanted end wall by means of, for example, screwing so as to direct the connector 80 diagonally upward in FIG. 8, to be away from the plane including the circuit board 76 within the casing body 72 in the manner as has been partly referred to in connection with the embodiment of FIGS. 1 and 2. A flexible lead wire 84 is connected at an end by means of soldering or the like to an output side of the circuit pattern provided on the circuit board 76, and this lead wire 84 is led through a penetrating hole 85 in the slanted end wall of the casing body 72 and further through an axial hole 86 of the output connector 80 to the exterior. In the present instance, it is preferable that the hole 85 in the casing body and the axial hole 86 of the output connector are made substantially to be of the same diameter which is slightly larger than the diameter of the lead wire 84, while keeping the length of the lead wire to be the shortest, that is, the minimum required extent so as to be contributive to the elimination of any loss.

According to this arrangement of the present embodiment, the lead wire 84 connected to the output side of the circuit pattern is led through the penetrating hole 85 in the casing body and the axial hole 86 of the output connector to the exterior substantially over the shortest distance, and the position for disposing the lead wire 84 can be stabilized. It has been found, therefore, that no substantial mismatching is caused to occur in the output impedance even when, for example, the output connector 80 is secured to be diagonal with respect to the casing as in the above, and the return loss at the output part can be reduced to a large extent.

Figure 11:
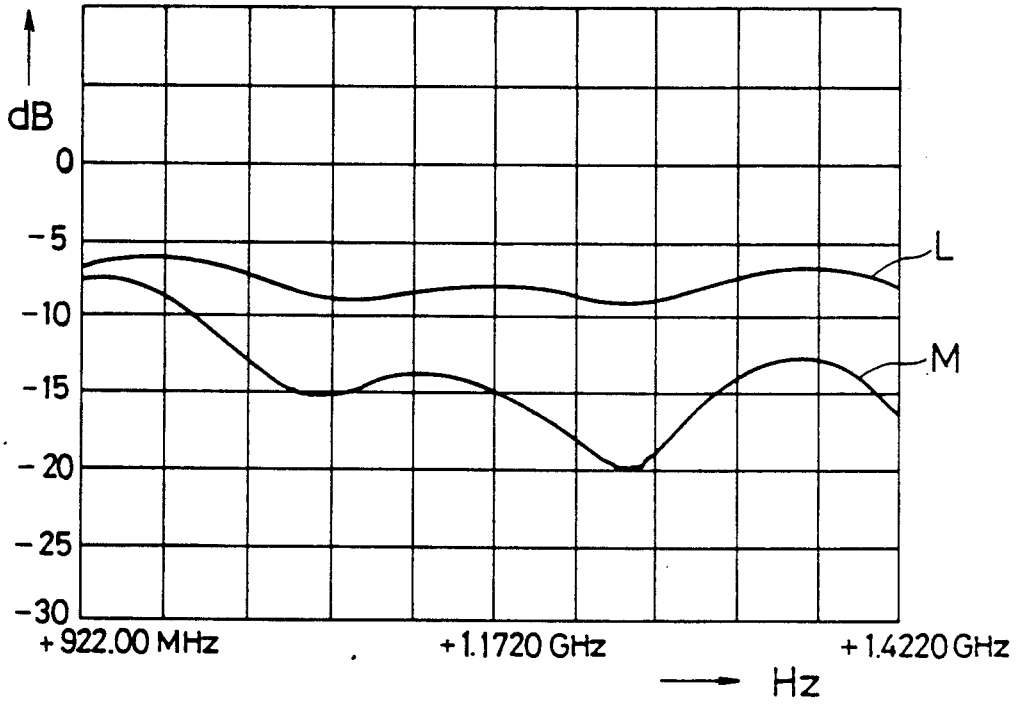
FIGS. 11 and 12 are diagrams showing the return loss at the output part of the converter shown in FIG. 8.
Figure 12:
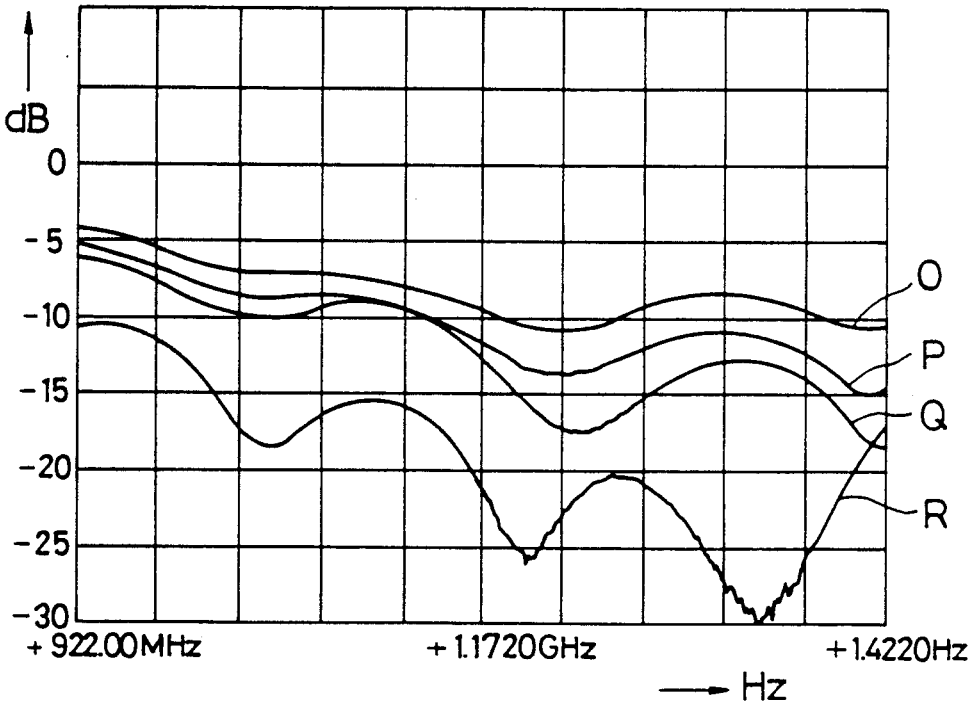

In the above connection, the return loss has been measured with the lead wire 84 of an outer diameter 1.2 mm employed and with the both holes 85 and 86 varied in the inner diameter to be 1.5 mm and 4.0 mm, and such results as represented by a curve M for the holes' diameter of 1.5 mm and by a curve L for the holes' diameter of 4.0 mm have been obtained (see FIG. 11). It will be appreciated here that the return loss at the output part can be more effectively reduced by rendering the diameter of the holes to be closer to the diameter of the lead wire. The return loss at the output part has been also measured with the length of the lead wire 84 varied from the minimum required length as a reference to three different lengths added by 2 mm, 4 mm and 6 mm sequentially, and such curves R, Q, P and O as in FIG. 12 have been obtained, wherein the curve R being for the minimum required length, the curve Q for the one of 2 mm increase, the curve P for the one of 4 mm increase and the curve O for the one of 6 mm increase, in view of which it has been also found that the return loss at the output part can be reduced more as the length of the lead wire 84 is made closer to the minimum required length.

Figure 13:
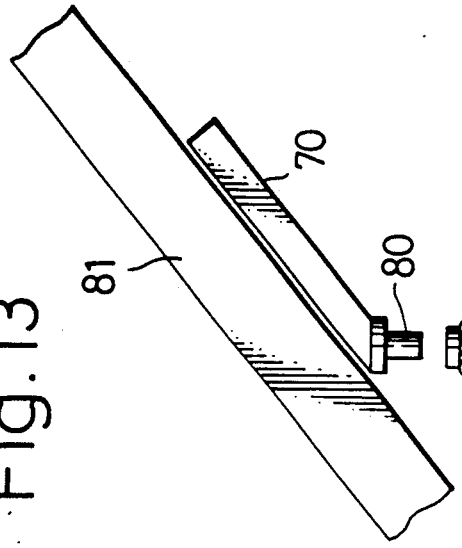
FIG. 13 is an explanatory view for a connection of the output connector in the converter of FIG. 8.

In the present embodiment, further, the flexible lead wire 84 allows the diagonally secured output connector 80 on the casing 71 to be connected to a cable connector without substantial increase in the return loss at the output part. Accordingly, as shown in FIG. 13, it is made possible to couple the cable connector 87 to the output connector of the converter 70 substantially in vertical direction when a planar antenna 81 carrying the converter 70 is installed as inclined on a roof of house or building or the like, so as to be effective to render the working ability excellent.

In the embodiment of FIGS. 8 to 10, the same components as the ones in the embodiment of FIGS. 1 and 2 are denoted by the same reference numerals as those in FIGS. 1 and 2 but as added by 60, and any other arrangement and operation than those referred to in the above are the same as those in the embodiment of FIGS. 1 and 2, with the thickness minimization sufficiently achieved.

Figure 14:
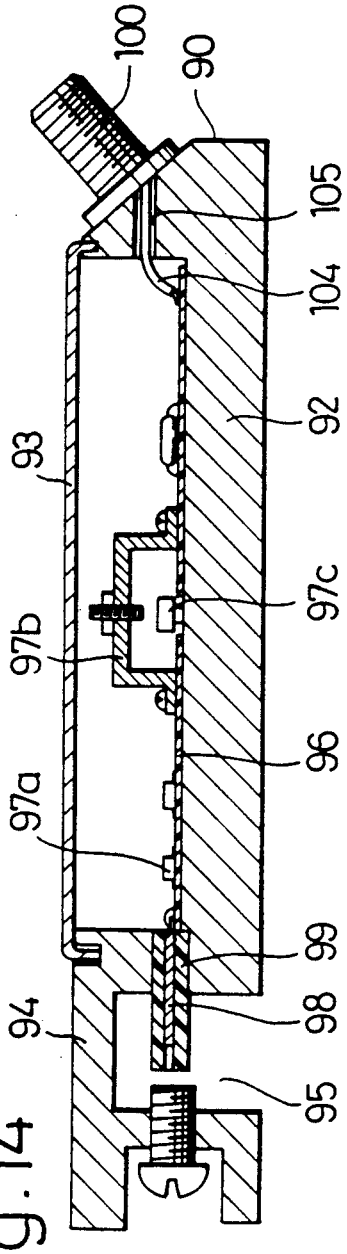
FIG. 14 shows in a sectioned side view an optimum embodiment of the converter according to the present invention.

Referring finally to FIG. 14, a converter 90 according to the present invention for use with the planar antenna is shown, in which the arrangements referred to with reference to the respective embodiments of FIGS. 1 and 2, FIG. 4 and FIGS. 8 to 10 are employed, with the arrangement of FIGS. 5 and 6 additionally employed preferably. In FIG. 14, the same components as those in the embodiment of FIGS. 1 and 2 and the same components as those in the embodiment of FIGS. 8 to 10 are denoted by the same reference numerals as those used in FIGS. 1 and 2 and in FIGS. 8 to 10 but as added by 80 and 20, respectively, and the sufficient thickness minimization can be attained with the same arrangement and operation as those in the foregoing embodiments. It will be readily appreciated here that such other components than HEMT 97*a* as a local oscillation cap 97*b* forming a local oscillating means, a dielectric resonator 97*c* and the like will be provided on the circuit board 96.

What is claimed is:

1. A frequency converter adapted to be disposed on a surface of a planar antenna, the converter comprising:

a converter body forming therein a first space which contains a circuit board, said circuit board carrying a circuit pattern, a flange positioned on a first wall of said converter body for defining an input part forming a waveguide structure, said input part forming therein a second space having an opening to the exterior, said input part including a second wall located opposite said first wall;

a probe for performing a microstrip-to-waveguide transformer, said probe oriented parallel to a plane of said circuit board and passing through an aperture in said first wall, a first end of said probe being connected to an input side of said circuit pattern on said circuit board, and a second end of said probe extending into said second space, a portion of said probe disposed within said aperture being entirely encased within a rod of dielectric material which engages a surface of said aperture to retain said probe within said first wall, said probe and said rod being formed as separate members relative to said circuit pattern and circuit board, respectively, and being spaced from said second wall; and an electrically conductive adjusting screw mounted in said second wall in coaxial alignment with said probe, said screw being adjustable toward and away from said second end of said probe for causing the microstrip-to-waveguide transform characteristics to be varied.

2. A converter according to claim 1, wherein a portion of said probe disposed within said second space is encased in said rod, the latter extending farther toward said adjusting screw than does said probe.

3. A converter according to claim 1, wherein said rod is cylindrical and a portion thereof disposed within said aperture includes alternating large and small diameter sections whereby said large diameter sections form annular projections which engage said surface of said aperture.

4. A converter according to claim 1, wherein said converter body includes a third wall and a hollow connector mounted thereto, a flexible lead wire connected to an output side of said circuit pattern and extending out of said converter body through said third wall and said hollow connector.

* * * * *